US005782016A

United States Patent [19]

Feller et al.

[11] Patent Number: 5,782,016

[45] Date of Patent: Jul. 21, 1998

[54] UNDERBODY SCRAPING APPARATUS WITH PITCH CONTROL

[75] Inventors: Richard Feller; Kevin J. Davis, both of Monroe, Wis.

[73] Assignee: Monroe Truck Equipment Inc., Monroe, Wis.

[21] Appl. No.: 640,246

[22] Filed: Apr. 30, 1996

[51] Int. Cl.[6] ..... E02F 5/00

[52] U.S. Cl. ..... 37/384; 37/234; 37/266; 280/769; 172/781; 172/796; 172/797

[58] Field of Search ..... 37/384, 231, 236, 37/266, 232–237; 172/781, 741, 793, 795, 796, 797; 280/769; 404/119

[56] References Cited

U.S. PATENT DOCUMENTS

| | | | |
|---|---|---|---|
| 1,269,016 | 6/1918 | Staszko | 37/232 X |
| 1,805,933 | 5/1931 | Victor | 37/232 X |
| 2,292,241 | 8/1942 | Reeves | 172/781 |
| 3,086,303 | 4/1963 | Weeks | 37/232 |
| 3,791,457 | 2/1974 | Hanser et al. | 172/781 |
| 3,858,661 | 1/1975 | Hallam et al. | 172/781 X |
| 3,858,662 | 1/1975 | Reid | 172/781 X |
| 4,058,174 | 11/1977 | Atherton et al. | 172/781 |
| 4,148,365 | 4/1979 | Anderson | 172/781 |
| 4,206,818 | 6/1980 | Beckham et al. | 172/781 |
| 4,279,312 | 7/1981 | Pyle | 172/793 X |
| 4,439,939 | 4/1984 | Blau | 37/236 X |
| 5,411,102 | 5/1995 | Nickels et al. | 37/231 X |

*Primary Examiner*—Terry Lee Melius
*Assistant Examiner*—Victor Batson
*Attorney, Agent, or Firm*—David J. Archer

[57] ABSTRACT

A scraper apparatus is disclosed for mounting under a body of a truck. The apparatus includes a table having a forward and a trailing end. The forward end is pivotally secured to the body of the truck. The arrangement is such that the table is permitted to pitch relative to the body of the truck. A bearing is secured to the table and is disposed between the forward and the trailing ends. A mold board scraper is disposed below and supported by the table with the mold board scraper being rotatably secured to the table by the bearing. A hydraulic cylinder secured to the mold board scraper rotates the scraper relative to the table and an actuator pivots the table for controlling the pitch of the table and the mold board secured to the table so that scraping of snow, ice and gravel regardless of the level thereof relative to the truck is permitted.

11 Claims, 3 Drawing Sheets

UNDERBODY SCRAPING APPARATUS WITH PITCH CONTROL

BACKGROUND OF THE INVENTION

1. Field of the invention

The present invention relates to a scraper apparatus for mounting under a body of a truck. More specifically, the present invention relates to a scraper apparatus having means for adjusting the pitch of the scraper relative to the body of the truck.

2. Information Disclosure Statement

The removal of snow and the maintenance of highways is an essential function of State and municipal authorities.

Typically, snow is removed by trucks fitted with front end snow plows and the like. However, in many applications and particularly for removing hard packed ice, snow and the like, a scraper is mounted beneath the body of a truck between the front and rear wheels thereof.

Although the aforementioned underbody scrapers are capable of reversing, that is means are provided for changing the angle of the scraper in order to eject snow from either side of the scraper, in certain applications, it is advantageous to be able to also alter the pitch of the scraper relative to the truck.

More specifically, in the present specification when referring to altering the pitch of the scraper what is meant is being able to adjust the angle of the cutting edge of the scraper relative to the level of the snow or ice being removed.

Applicants are aware of an underbody scraper invented 50 years ago by Willett and manufactured by Schmitt Engineering & Equipment Co., Ltd., of New Berlin, Wis. The Schmitt underbody scraper has a scraper pitch control. However, the aforementioned Schmitt underbody scraper is of lightweight construction, is excessively complex, and requires considerable maintenance.

The present invention overcomes the aforementioned problems of the prior art arrangements by providing an extra heavy duty, year round underbody scraper that is capable of handling snow, packed ice and a higher volume of snow at various speeds in the winter. The scraper of the present invention is also able to handle gravel for road maintenance and particularly shoulder maintenance in the summer.

Therefore, it is a primary objective of the present invention to provide an underbody scraper which overcomes all the disadvantages of the prior art arrangements and which makes a considerable contribution to the art of removing snow and ice from highways.

Other objects and advantages of the present invention will be readily apparent to those skilled in the art by a consideration of the description contained hereinafter taken in conjunction with the annexed drawings.

SUMMARY OF THE INVENTION

The present invention relates to a scraper apparatus for mounting under a body of a truck. The apparatus includes a table having a forward end and a trailing end. The forward end is pivotally secured to the body of the truck, the arrangement being such that the table is permitted to pitch relative to the body of the truck.

A bearing is secured to the table such bearing being disposed between the forward and the trailing ends of the table.

A mold board scraper is disposed below the table and is supported by the table with the scraper being rotatably secured to the table by the bearing.

Means are secured to the mold board scraper for rotating the scraper relative to the table. Additionally, pitch means are provided for pivoting the table for controlling the pitch of the table and the mold board secured to the table so that scraping of snow, ice and gravel is permitted regardless of the level thereof relative to the truck.

In a more specific embodiment of the present invention, the table is of generally circular configuration and the forward end thereof defines a recess for the reception therein of a ball joint bearing for pivotally securing the forward end of the table to the body of the truck.

The trailing end of the table is bifurcated such that the trailing end includes a first and a second portion. An anchor bearing extends from one of the portions and is secured to the frame of the truck such that the table is permitted to pitch about an axis extending through the anchor bearing and the forward end of the table.

The anchor bearing is located rearwardly relative to the forward end of the table, the arrangement being such that the table is permitted to pitch relative to the frame of the truck about the forward end and the anchor bearing.

The bearing permits rotation of the mold board scraper about an axis which is normal to the table.

The means for rotating the scraper includes a hydraulic cylinder which extends between the scraper and the table such that when the cylinder is actuated, the scraper rotates relative to the table about the bearing. More particularly, the hydraulic cylinder extends between the scraper and the trailing end of the table.

In a preferred embodiment of the present invention, the means for rotating further includes a further hydraulic cylinder which extends between the scraper and the trailing end of the table, the bearing being disposed between the cylinder and the further cylinder.

The pitch means includes a hydraulic actuator secured to the table and extending between the table and the body of the truck. The actuator controls the pitch of the mold board scraper via the table.

Additionally, the scraper apparatus includes hold down block means rigidly secured to the table and disposed between the table and the scraper. The arrangement is such that when the means for rotating the scraper are actuated, the scraper secured to the block means bearingly slides relative to the table. The block means and the bearing cooperate together to hold the scraper down and to maintain the scraper in a longitudinal plane which is substantially parallel to a further plane extending through the table.

Many modifications and variations of the present invention will be readily apparent to those skilled in the art by a consideration of the detailed description contained hereafter taken in conjunction with annexed drawings. However, such modifications and variations fall within the spirit and the scope of the present invention as defined by the appended claims.

BRIEF DESCRIPTION OF THE INVENTIONS

FIG. 1 is a side elevational view of the scraper apparatus according to the present invention when fitted beneath an underbody of a truck;

FIG. 2 enlarged top view of the scraper apparatus shown in FIG. 1, the apparatus being partially in section to show the mold board scraper;

Similar reference characters refer to similar parts throughout the various views of the drawings.

DETAILED DESCRIPTION OF THE DRAWINGS

Figure 1:
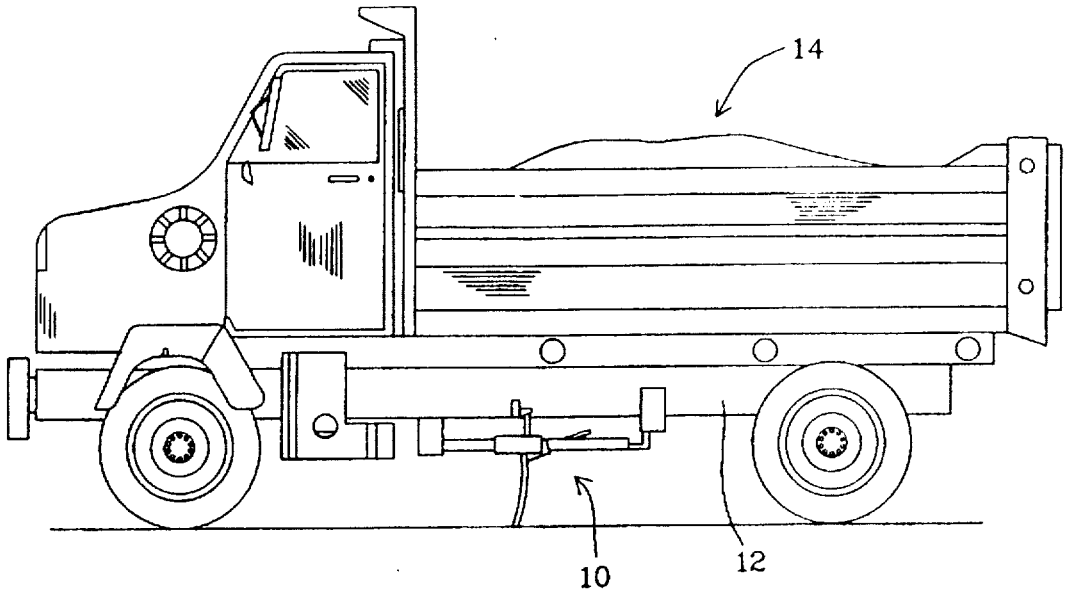

FIGS. 1 through 6 show a scraper apparatus generally designated 10 according to the present invention mounted under a body 12 of a truck generally designated 14.

As shown in FIGS. 2–6, the apparatus 10 includes a table 16 having a forward end 18 and a trailing end 20. The forward end 18 is pivotally secured to the body 12 of the truck 14. The arrangement is such that the table 16 is permitted to pitch as specifically shown in FIGS. 5 and 6 relative to the body of the truck 14.

A bearing 22 is secured to the table 16. The bearing 22 is disposed between the forward end 18 and the trailing end 20 of the table 16.

A mold board scraper 24 is disposed below and is supported by the table 16. The scraper 24 is rotatably secured to the table 16 by the bearing 22.

Means generally designated 26 are secured to the mold board scraper 24 for rotating the scraper 24 relative to the table 16.

The scraper apparatus 10 also includes pitch means generally designated 28 for pivoting the table 16 for controlling the pitch of the table 16 and the mold board 24 secured to the table 16 so that scraping of snow, ice and gravel is permitted regardless of the level thereof relative to the truck 14.

Figure 2:
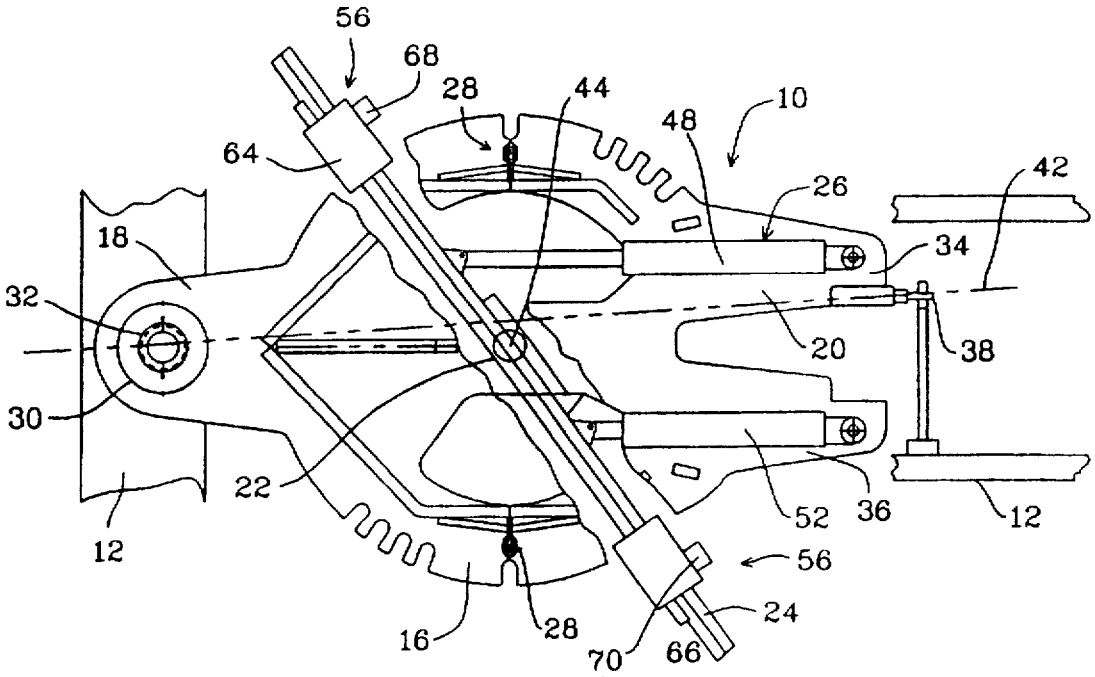

As shown particularly in FIGS. 2 an 3, the table 16 is of generally circular configuration. Additionally, the forward end 18 of the table 16 defines a recess 30.

The scraper apparatus 10 also includes a ball joint bearing 32 which is disposed within the recess 30 for pivotally securing the forward end 18 of the table 16 to the body 12 of the truck 14.

In a preferred embodiment of the present invention, the trailing end 20 of the table 16 is bifurcated such that the trailing end 20 includes a first and a second portion 34 and 36 respectively. An anchor bearing 38 extends from one of the portions 34 and secured to the body 12 of the truck 14 such that the table 16 is permitted to pitch as indicated by the arrow 40 about an axis 42 which extend through the anchor bearing 38 and the forward end 18 of the table 16.

Figure 3:
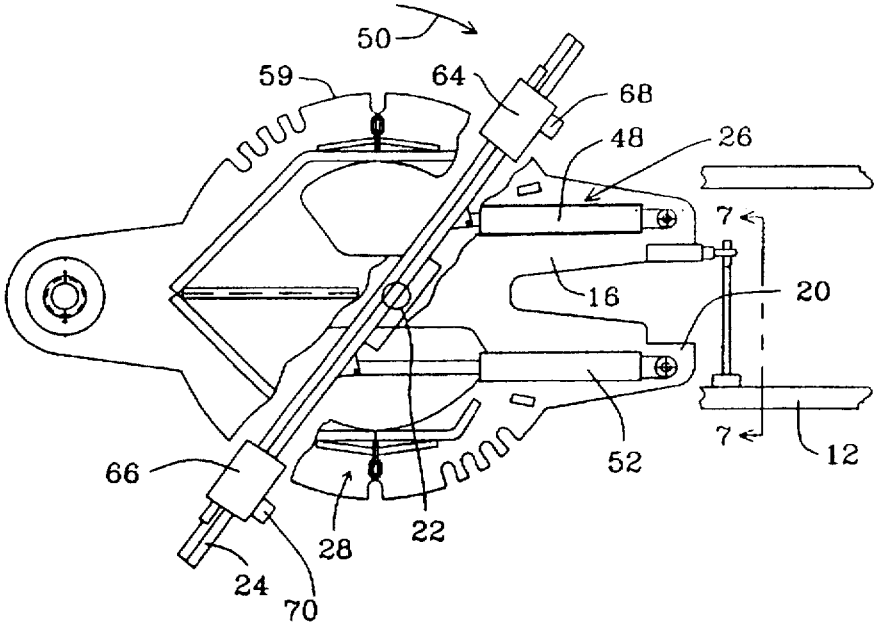
FIG. 3 is a similar view to that shown in FIG. 2 and shows the scraper reversed for ejecting snow and the like from the opposite end of the mold board scraper.

As shown in FIGS. 2 and 3, the anchor bearing 38 is disposed between the tailing end 20 of the table 16 and the body 12 of the truck 14. The anchor bearing 38 is located rearwardly relative to the forward end 18 of the table 16. The arrangement is such that the table 16 is permitted to pitch as indicated by the arrow 40 (shown in FIGS. 5 and 6) relative to the body of the truck 14 about the forward end 18 and the anchor bearing 38.

Figure 4:
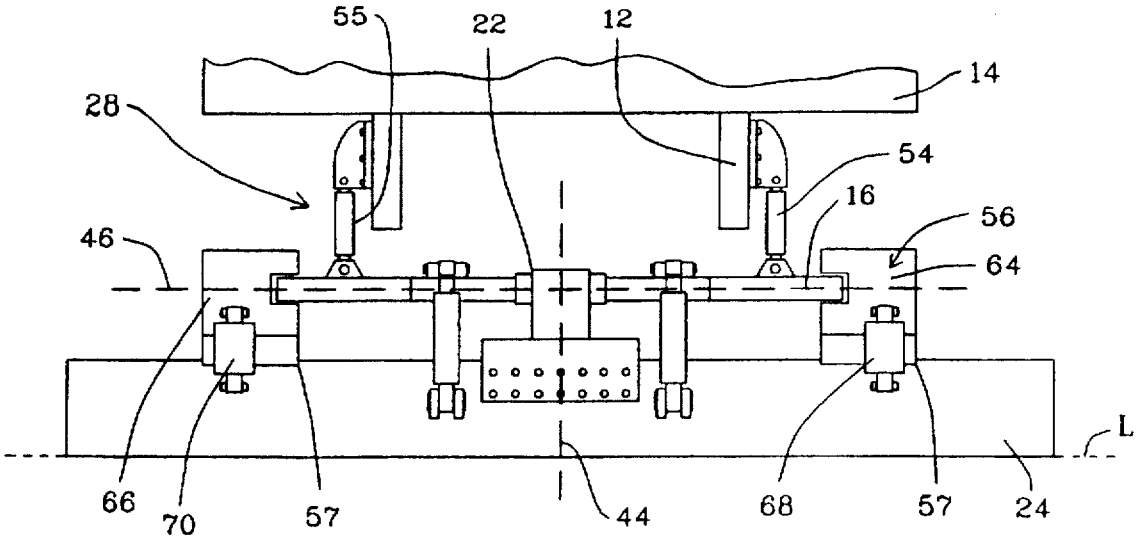
FIG. 4 is a rear elevational view of the scraper apparatus shown in FIG. 1 showing the scraper cutting edge disposed substantially parallel to the snow being removed.

As shown in FIG. 4, the bearing 22 permits rotation of the mold board scraper 24 about an axis indicated by the line 44 which is normal to a plane 46 extending through the table 16.

The means 26 for rotating the table 16 includes a hydraulic cylinder 48 which extend between the scraper 24 and the table 16 such that when the cylinder 48 is actuated, the scraper 24 rotates as indicated by the arrow 50 relative to the table 16 about the bearing 22.

Preferably, the hydraulic cylinder 48 extends between the scraper 24 and the trailing end 20 of the table 16.

The apparatus 10 also includes a further hydraulic cylinder 52 which extend between the scraper 24 and the trailing end 20, the bearing 22 being disposed between the cylinder 48 and the further cylinder 52.

The pitch means generally designated 28 includes a hydraulic actuator 54 as shown in FIG. 4. The actuator 54 is secured to the table 16 and extends between the table 16 and body 12 of the truck 14. The actuator 54 controls the pitch of the mold board scraper 24 via the table 16.

The pitch means 28 also includes a further hydraulic actuator 55 which is also pivotally secured at one end thereof to the table 16 and at the other end to the body 12 of the truck.

The apparatus 10 also includes a hold down block means generally designated 56 which are pivotally secured by hinge means 57 to the scraper 24 and disposed between the table 16 and the scraper 24. The arrangement is such that when the means 26 for rotating the scraper 24 are actuated, the scraper 24 bearingly slides on the circumferential edge 59 of the table 16. The block means 56 and the bearing 22 cooperate together to hold the scraper 24 and to maintain the scraper 24 in a longitudinal plane L which extend substantially parallel to the plane 46 of the table 16 as shown in FIG. 4.

Figure 7:
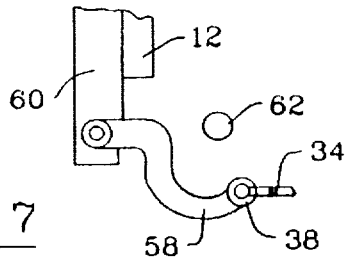
FIG. 7 is a view taken on the line 7—7 of FIG. 3 and shows the anchor bearing and the attachment thereof to the truck.

FIG. 7 is a sectional view taken on the line 7—7 of FIG. 3 and shows the anchor bearing 38 and a connecting link 58 extending from the anchor bearing 38 to a bracket 60 depending from the underbody 12 of the truck. As shown, the link 58 is of S-shaped configuration so that a drive shaft 62 of the truck does not interfere with the apparatus 10.

Figure 5:
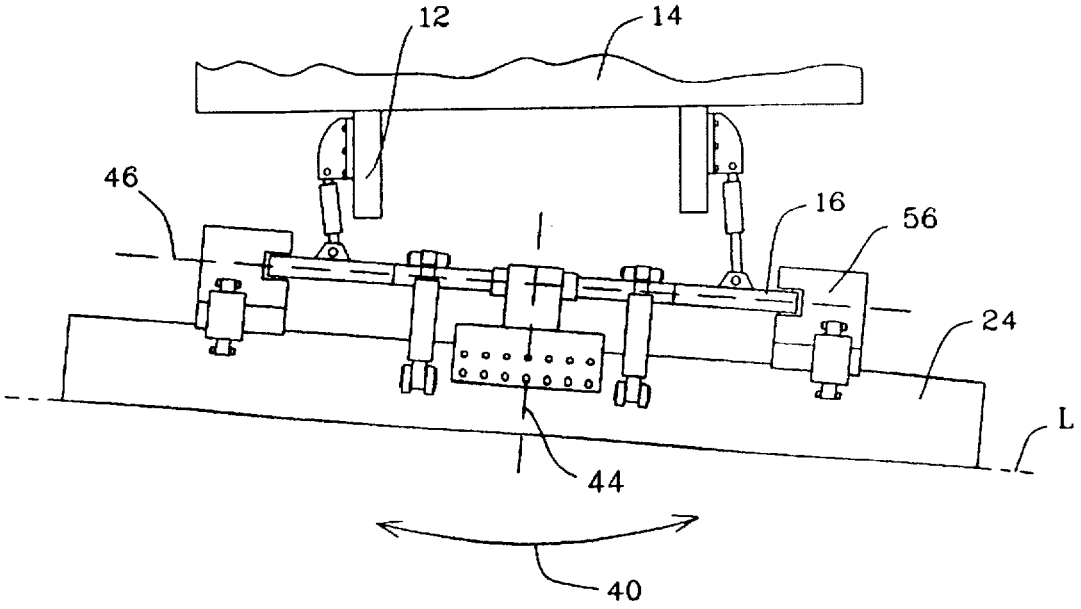
FIG. 5 is a similar view to that shown in FIG. 4 but shows the mold board scraper having the pitch thereof adjusted so that the angle of the cutting edge relative to the snow to be removed has been altered.
Figure 6:
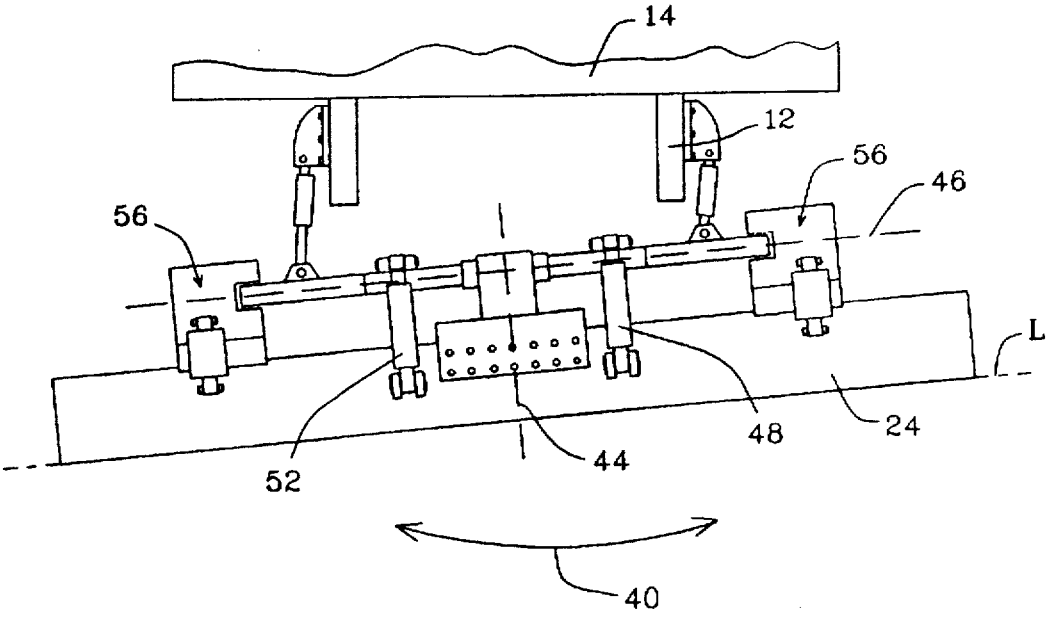
FIG. 6 is a similar view to that shown in FIG. 4 but shows the mold board scraper having the pitch thereof adjusted in the opposite direction to that shown in FIG. 5.

Additionally, the hold down block means 56 shown in FIGS. 2-6 includes a first and second block 64 and 66 respectively. Hydraulic rams 68 and 70 extend respectively from the blocks 64 and 66 to the moldboard 24 as shown in FIGS. 4–6 so that the attitude of the moldboard 24 relative to the snow can be altered by pivoting the moldboard 24 about the hinge means 57 so that the moldboard can be retracted to an inoperative position.

The apparatus according to the present invention is particularly rugged in construction. The table 16 for example is fabricated from 1 inch plate steel. Also, the apparatus permits the changing of the pitch of the moldboard as well as reversing. Additionally, the moldboard is held down relative to the table while permitting a positive change in the attitude of the moldboard.

What is claimed is:

1. A scraper apparatus for mounting under a body of a truck, said apparatus comprising:

a table having a forward end and a trailing end, said forward end capable of being pivotally secured to the body of the truck, the arrangement being such that said table is permitted to pitch relative to the body of the truck;

a bearing secured to said table, said bearing being disposed between said forward and said trailing ends;

a mold board scraper disposed below and supported by said table, said mold board scraper being rotatably secured to said table by said bearing;

means secured between said mold board scraper and said table for rotating said mold board scraper relative to said table;

pitch means secured to said table and extending between said table and said body for moving said table for controlling said pitch of said table and said mold board so that scraping of snow, ice and gravel is permitted regardless of the level thereof relative to the truck; and further including:

an anchor bearing disposed between said trailing end of said table and the body of the truck, said anchor bearing being located rearwardly relative to said forward end of said table, the arrangement being such that said table is permitted to pitch relative to the body of the truck about said forward end and said anchor bearing.

2. A scraper apparatus as set forth in claim 1 wherein said table is of generally circular configuration.

3. A scraper apparatus as set forth in claim 1 wherein said forward end of said table defines a recess.

4. A scraper apparatus as set forth in claim 1 wherein said bearing permits rotation of said mold board scraper about an axis normal to said table.

5. A scraper apparatus as set forth in claim 1 wherein said means for rotating said scraper includes:

a hydraulic cylinder extending between said scraper and said table such that when said cylinder is actuated, said scraper rotates relative to said table about said bearing.

6. A scraper apparatus as set forth in claim 5 wherein said hydraulic cylinder extends between said scraper and said trailing end of said table.

7. A scraper apparatus as set forth in claim 6 further including:

a further hydraulic cylinder extending between said scraper and said trailing end, said bearing being disposed between said cylinder and said further cylinder.

8. A scraper apparatus as set forth in claim 1 wherein said pitch means includes:

a hydraulic actuator secured to said table and extended between said table and the body of the truck, said actuator controlling said pitch of said mold board scraper via said table.

9. A scraper apparatus as set forth in claim 1 further including:

hold down block means slidably secured to said table and disposed between said table and said scraper, the arrangement being such that when said means for rotating the said scraper is actuated, said scraper bearingly slides relative to said block means, said block means and said bearing cooperating together to hold said scraper down and to maintain said scraper in a longitudinal plane which is substantially parallel to a further plane extending through said table.

10. A scraper apparatus for mounting under a body of a truck, said apparatus comprising:

a table having a forward end and a trailing end, said forward end being pivotally secured to the body of the truck, the arrangement being such that said table is permitted to pitch relative to the body of the truck, said forward end of said table defining a recess:

a bearing secured to said table, said bearing being disposed between said forward and said trailing ends;

a mold board scraper disposed below and supported by said table, said mold board scraper being rotatably secured to said table by said bearing;

means secured between said mold board scraper and said table for rotating said mold board scraper relative to said table;

pitch means secured to said table and extending between said table and said body for moving said table for controlling said pitch of said table and said mold board so that scraping of snow, ice and gravel is permitted regardless of the level thereof relative to the truck; and said scraper apparatus further including:

a ball joint bearing disposed within said recess for pivotally securing said forward end of said table to the body of the truck.

11. A scraper apparatus for mounting under a body of a truck, said apparatus comprising:

a table having a forward end and a trailing end, said forward end capable of being pivotally secured to the body of the truck, the arrangement being such that said table is permitted to pitch relative to the body of the truck;

a bearing secured to said table, said bearing being disposed between said forward and said trailing ends;

a mold board scraper disposed below and supported by said table, said mold board scraper being rotatable secured to said table by said bearing;

means secured between said mold board scraper and said table for rotating said mold board scraper relative to said table;

pitch means secured to said table and extending between said table and said body for moving said table for controlling said pitch of said table and said mold board so that scraping of snow, ice and gravel is permitted regardless of the level thereof relative to the truck;

said trailing end of said table being bifurcated, said trailing end including:

a first and a second portion; and an anchor bearing extending from one of said portions and secured to the body of the truck such that said table is permitted to pitch about an axis extending through said anchor bearing and said forward end of said table.

* * * * *